US006948624B1

(12) United States Patent
Drower

(10) Patent No.: US 6,948,624 B1
(45) Date of Patent: Sep. 27, 2005

(54) DESK TOP STORAGE HOLDER

(75) Inventor: Herbert M. Drower, Wilmette, IL (US)

(73) Assignee: Transilwrap Company, Inc., Franklin Park, IL (US)

( * ) Notice: Subject to any disclaimer, the term of this patent is extended or adjusted under 35 U.S.C. 154(b) by 17 days.

(21) Appl. No.: 10/630,095

(22) Filed: Jul. 30, 2003

(51) Int. Cl.[7] ..... A47F 7/00

(52) U.S. Cl. ..... 211/45; 211/120; 211/69.8; 211/89.01

(58) Field of Search ..... 211/120, 69.8, 211/89.01, 46, 45; 312/184

(56) References Cited

U.S. PATENT DOCUMENTS

| | | | | |
|---|---|---|---|---|
| 231,969 | A | 9/1880 | Perkins | |
| 586,238 | A | 7/1897 | King | |
| 1,026,241 | A | 5/1912 | Buckingham | |
| 1,214,606 | A | 2/1917 | Steig | |
| 1,388,154 | A | 8/1921 | Coutts | |
| 1,429,846 | A | 9/1922 | Coutts | |
| 1,508,680 | A | 9/1924 | Daniels | |
| 1,746,577 | A | 2/1930 | Berglund et al. | |
| 1,822,734 | A | 9/1931 | Harrington | |
| 2,397,291 | A | 3/1946 | Robertson | |
| 2,430,624 | A | 11/1947 | Vollmer | |
| 2,591,805 | A | 4/1952 | Gossett | |
| 2,615,577 | A | 10/1952 | Bartleman | |
| 2,707,052 | A * | 4/1955 | Brown | 211/65 |
| D175,455 | S | 8/1955 | Bartleman | |
| 2,975,949 | A | 3/1961 | Lutsky | |
| 3,094,129 | A | 6/1963 | Wills | |
| 3,165,283 | A | 1/1965 | Borisof | |
| 3,305,100 | A | 2/1967 | Barbee | |
| 3,309,052 | A | 3/1967 | Borisof | |
| 3,363,340 | A | 1/1968 | McKinley | |

(Continued)

FOREIGN PATENT DOCUMENTS

| | | |
|---|---|---|
| GB | 8483 | 4/1904 |

*Primary Examiner*—Robert W Gibson, Jr.
(74) *Attorney, Agent, or Firm*—Cook, Alex, McFarron, Manzo, Cummings & Mehler, Ltd.

(57) ABSTRACT

A desk top or vertical surface storage rack for small items. The rack includes a rectangular, U-shaped base having a pair of outwardly extending legs separated by an upwardly opening transversely extending slot. An outwardly opening strip receiving slit is formed in each of the outwardly extending legs and a wider strip receiving slit is formed in the bottom of the slot. Each base includes a pair of retainer loops formed of a strip of a tough, resilient, abrasive-resistant resin. Each retainer loop has a bight portion positioned outwardly of the outwardly extending legs of the U-shaped base and has two legs extending from the bight portion. One of the legs of the strip has its distal end positioned in the strip receiving slit of one of the base upstanding legs and the other of the legs of each loop is positioned in the wider receiving slit in the bottom of the slot. The legs of each of the strips positioned in the wider receiving slit in the bottom of the slot are formed integrally with each other to form a bight portion between the pair of retainer loops. A rod is provided to fasten the distal ends of the retainer loop legs to the base. Grooves are formed in the side walls of the base for mounting the base in a receiver which can hold a number of bases mounted end to end. An opening is formed in each leg near its distal end for mounting the retainer loop on the support bar. An eyelet surrounds each opening with contiguous legs of adjacent loops held together by a single eyelet.

7 Claims, 3 Drawing Sheets

U.S. PATENT DOCUMENTS 3,388,809 A 6/1968 Irish
3,405,809 A 10/1968 Schatz
3,777,800 A * 12/1973 Susoev ..... 160/84.04
3,812,976 A 5/1974 Rempel
4,176,752 A 12/1979 Taber
4,757,906 A 7/1988 Ovitz, III
4,936,469 A 6/1990 Drower
5,355,928 A * 10/1994 Robertson ..... 160/84.04
5,398,823 A 3/1995 Anders
5,419,443 A 5/1995 Niederberger et al.
5,570,794 A 11/1996 Drower
5,718,342 A 2/1998 Drower et al.
5,727,697 A * 3/1998 Ricciardelli et al. ..... 211/89.01
5,775,520 A 7/1998 Drower
5,779,066 A 7/1998 Drower et al.
5,915,573 A 6/1999 Drower et al.

* cited by examiner

Fig. 5.
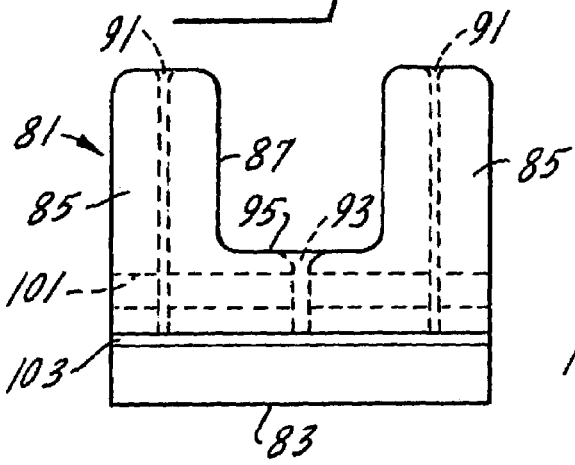
Fig. 6.
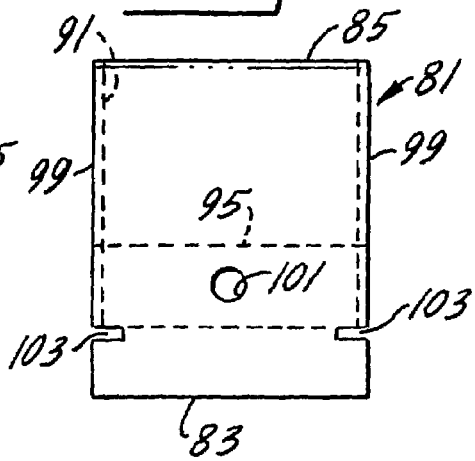
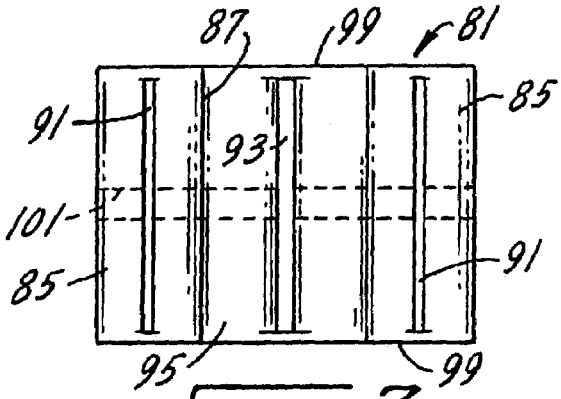
Fig. 7.

DESK TOP STORAGE HOLDER

BACKGROUND AND SUMMARY OF THE INVENTION

Storage racks for small articles, ranging from pencils to pens and other items such as paint brushes, cassettes and small container are shown in U.S. Pat. Nos. 4,936,469; 5,570,794 and 5,718,342. The storage racks described in these patents are not specifically intended to support thin, planar objects such as business calling cards, index cards and file folders in an upstanding relation to a supporting surface such as a desk although they may be used to, store such items in a hanging position. I have invented a container for the storage of thin, planar objects in an upright orientation on a desk-which is shown and described in my pending patent application Ser. No. 10/242,650, filed Sep. 12, 2002. This container includes multiple support loops which may be of varying heights and widths.

SUMMARY OF THE INVENTION

It is a principal object of the present invention to provide a small storage holder or storage rack for thin, planar objects such as business calling cards, index cards, file folders and even small, non-planar objects such as pencils, pens, cassettes, etc. that can handily be located on a desk top, a credenza, a file cabinet or a table where the holder support these objects in an upstanding orientation but may also be attached to a vertical support surface to support these objects in a hanging orientation such as on a workstation panel or on a vertical wall in a kitchen.

Another object of this invention is a desk top holder which is formed of only one pair of upstanding loops supported on a small, self-contained base.

Still another object of this invention is a desk top storage holder having only one pair of upstanding support loops which is formed by bending a continuous strip of a tough, resilient, abrasive-resistant resin into the desired looped shape.

Yet another object of this invention is in an elongated, high capacity storage holder for a desk top or a vertical support surface containing a plurality of small storage racks aligned in a row.

A further object of this invention is a desk top storage holder having multiple pairs of upstanding support loops which are formed by bending a continuous strip of tough, resilient, abrasive-resistant resin into a multiple looped shape, which loops are held and supported by a rod in the holder.

A still further object of this invention is a desk top storage holder in the multiple loops are held to the rod by eyelets which fit over the rod and fasten legs of adjacent loops to each other.

Other objects of the invention will be found in the following specification, claims and drawings.

BRIEF DESCRIPTION OF THE DRAWINGS

FIG. 5 is a side elevational view of another embodiment of the self-contained storage holder base of this invention with the support loops removed for clarity of illustration;

FIG. 6 is an end elevational view of the storage holder base of FIG. 5;

FIG. 7 is a top plan view of the storage holder base of FIG. 5.;

DESCRIPTION OF THE PREFERRED EMBODIMENTS

Figure 1:
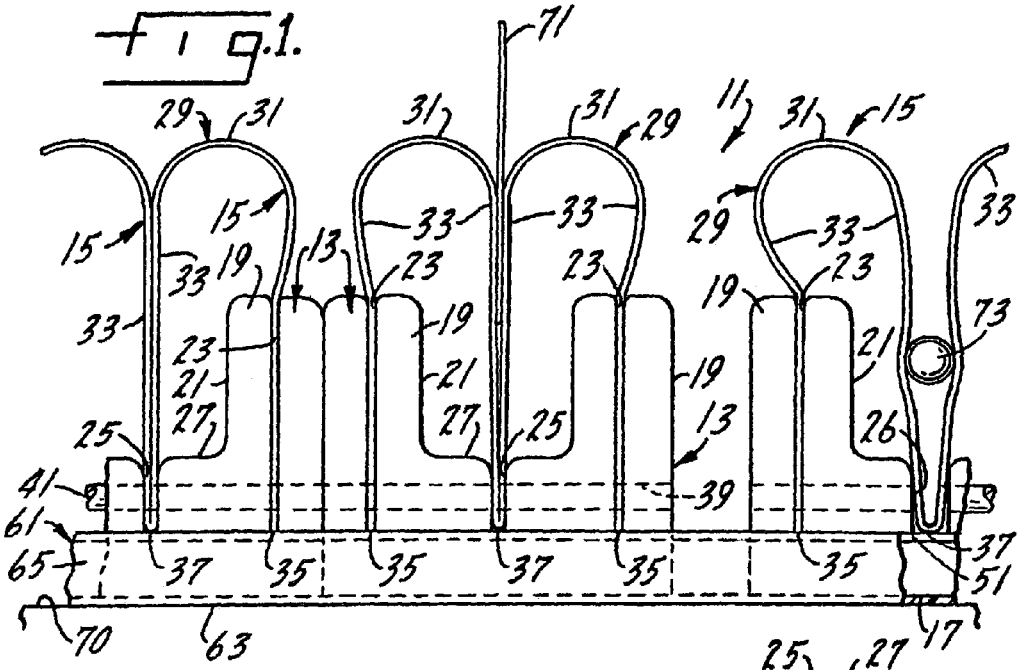
FIG. 1 of the drawings is a partial, side elevational view of a plurality of self-contained storage holders aligned in a row on a support base and showing objects supported between a pair of loops of some of the self-contained holders.
Figure 2:
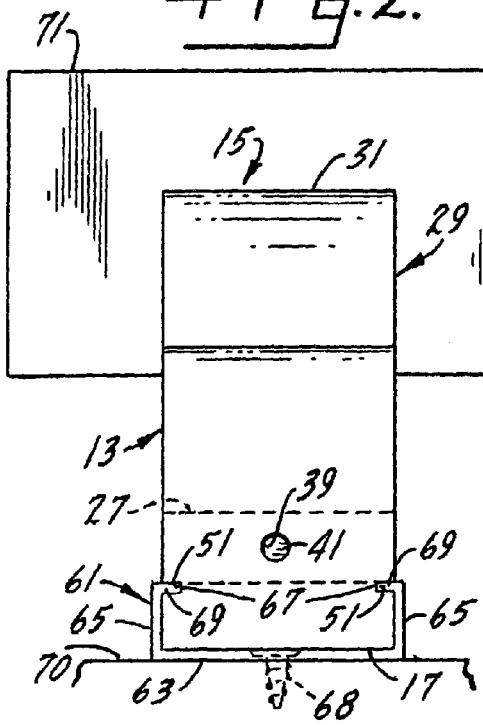
FIG. 2 is a vertical, transverse view taken through one of the self-contained storage holders of FIG. 1 supporting a thin, planar object such as a business card.
Figure 4:
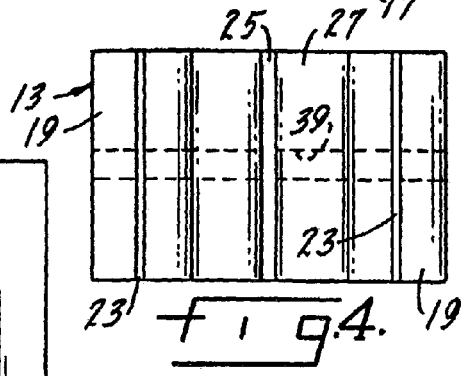
FIG. 4 is a top plan view of the storage holder base of FIG. 3.
Figure 3:
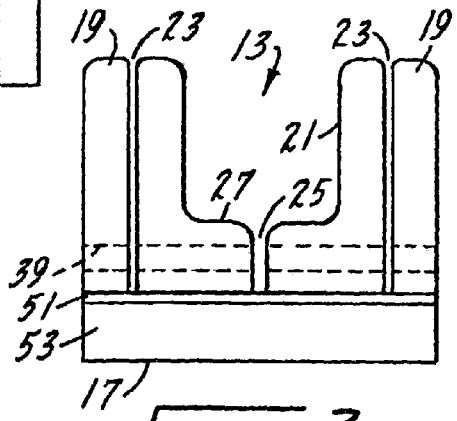
FIG. 3 is a side elevational view of a storage holder base with the support loops removed for clarity of illustration.
Figure 8:
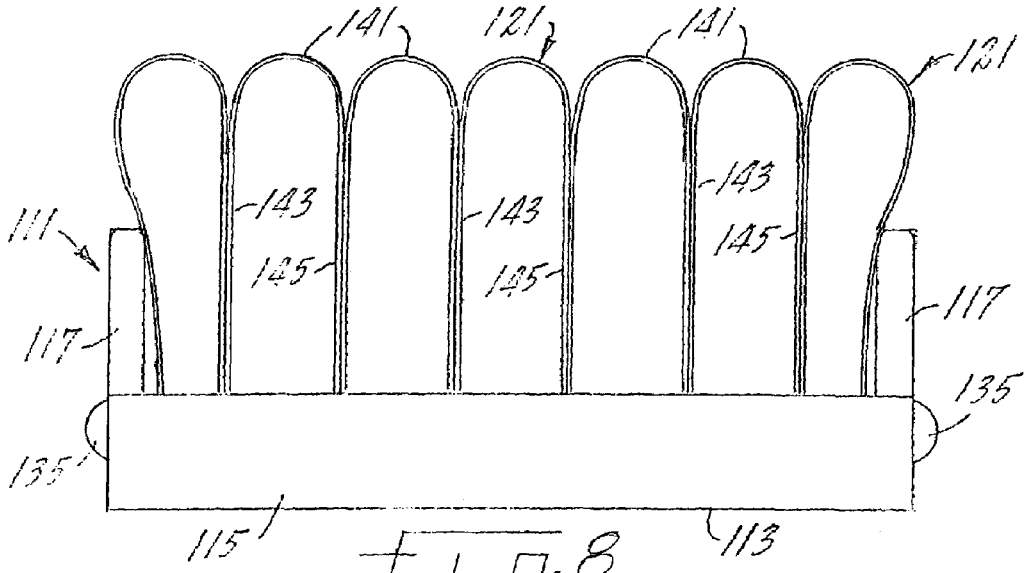
FIG. 8 is a side elevational view of yet another embodiment of a storage holder of this invention.
Figure 9:
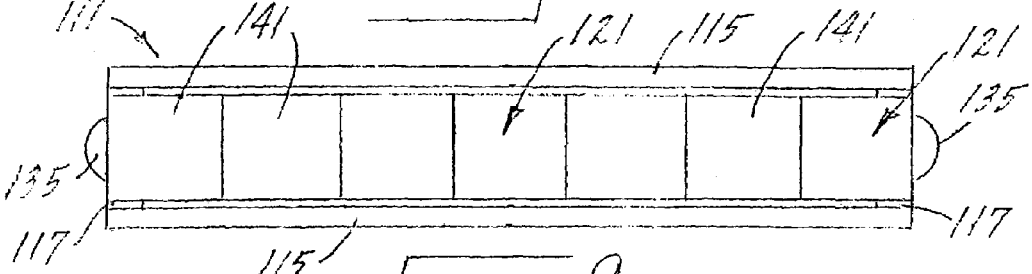
FIG. 9 is a top plan view of the storage holder of FIG. 8.

A first embodiment of the desk top storage rack or holder of this invention is shown FIGS. 1–4 of the drawings. The desk top storage rack 11 includes a base 13 and a pair of retainer loops 15 mountedly attached to the base and extending upwardly above the base when the base is supported on a horizontal surface. The base 13 is preferably molded in one piece of a suitable plastic, but other materials and other methods of forming the base may be utilized. The base is formed with a generally rectangular bottom surface 17 and presents a U-shaped side elevational appearance with spaced apart, upstanding legs 19 separated by an upwardly opening, transversely extending slot 21. An upwardly opening loop receiving slit 23 is formed in each of the upstanding legs 19 and a wider, upwardly opening loop receiving slit 25 is formed in the bottom wall 27 of the slot 21. The base 13 depicted on the right-hand side of FIG. 1 of the drawings is modified in that its wider, upwardly opening slit which receives the pair of legs 33 is widened to as much as one-quarter inch to form a slot 26 to better hold a thicker object such as the pen or pencil 73 by allowing it to move deeper between the legs 33.

The pair of retainer loops 15 are formed of a single strip 29 of a tough, resilient, abrasive-resistant resin, preferably a polyester resin or a laminate. The preferred construction for the strip 29 forming the retainer loops is two layers of oriented polyethylene terephthalate laminated with a center layer of polyethylene, the same basic construction as is used in commercial identification cards and similar items. Each of the two retaining loops 15 is formed with a bight portion 31 joining a pair of legs 33, which in this embodiment of the invention are of equal length. Each of the retainer loops is positioned in the base 13 with its bight portion 31 positioned outwardly above the upstanding legs 19 of the U-shaped base. One of the legs 33 of each retaining loop has a distal end 35 positioned in a strip receiving slit 23 of one of the: upstanding legs of the base 13 and the other leg 33 of the retaining loop is connected to a leg 33 of the adjoining loop 15 to form an interior bight 37 which is positioned in the wider slit 25 formed in the bottom wall of the slot 21 of the base 13. Near the distal end of each of the legs of each loop 15, a passage 39 (see FIG. 2) extends through the strip to receive a metal rod 41 which extends through the base and through the passages 39 to secure the retaining loops to the base. The single strip 29 may be cut from a longer strip of a tough, resilient, abrasive-resistant resin with the passages 39 punched or otherwise formed in the same or subsequent operations. Grooves 51 are formed in the opposite side walls 53 of the base 13 and extend the length of each side wall.

An elongated receiver 61 of C-shaped transverse cross-section is provided to hold a plurality of storage racks 11 in an end to end relation. The receiver 61 may be formed of metal or a suitable plastic and includes a bottom wall 63, side walls 65 and a substantially open top 67. Oppositely facing, inwardly extending fingers 69 are formed at the open top. The fingers 69 fit into the grooves 51 in the opposite side walls of the base 13 of each storage rack 11 to prevent the storage racks to be upwardly removed from the receiver while permitting the storage racks to be slid along the length of the receiver for proper positioning. The receiver may be positioned on a desk top to support a plurality of individual storage racks with their retainer loops opening upwardly in an object receiving position or may be attached to a wall 70 or similar vertical surface to function as a hanging storage rack. The storage rack may be fastened to the vertical surface by screws 68 or other conventional fasteners such as double sided, tape, magnets, etc. Shown in FIGS. 1 and 2 of the drawings are objects such as a business card 71 and tubular objects such as a pen or pencil 73 supported between a pair of loops 15.

A second embodiment of the desk top storage rack of this invention is shown in FIGS. 5, 6 and 7 of the drawings. The invention of the second embodiment differs from the desk top or hanging storage rack 11 of the first embodiment of the invention only in the construction of the base. The base 81 is preferably molded in one piece of a suitable plastic but may be formed of several component parts fastened together as hereinafter described or may be formed of other materials utilizing methods of manufacture suitable to the materials used. The base 81 is formed with a generally rectangular bottom surface 83 and presents a U-shaped side elevational appearance with spaced apart, upstanding legs 85 separated by an upwardly opening, transversely extending slot 87. An upwardly opening loop receiving slit 91 is formed in each of the upstanding legs 85 and a wider, upwardly opening loop receiving slit 93 is formed in the bottom wall 95 of the slot 87. A panel 99 is formed on each side of the base 81 to enclose the ends of the transversely extending loop receiving slits 91 and 93. These panels or enclosing walls may be formed integrally with the base 81 or may be formed integrally with the base 81 or may be formed separately and adhered to the base 81. A passage 101 is formed to extend longitudinally through the base to receive a loop retaining rod similar to rod 41 previously described Grooves 103 are formed in the side walls of the base to permit the base 81 to be installed in a receiver similar in construction to the receiver 61 previously described. As shown most clearly in FIG. 6 of the drawings, the grooves 103 extend into the base inwardly of the panels 99.

Figure 10:
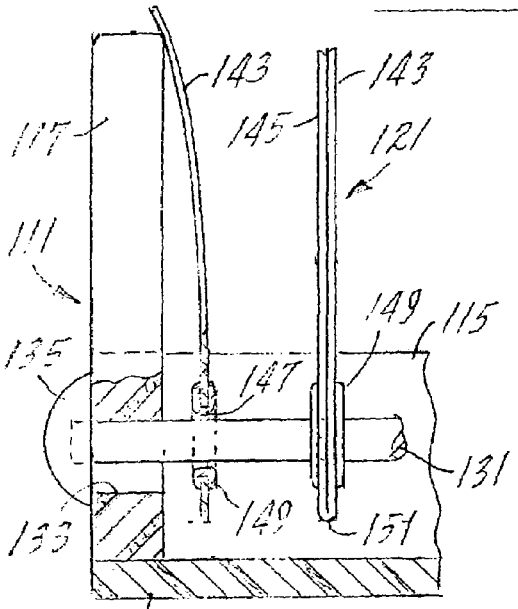
FIG. 10 is an enlarged, partial view of the storage holder of FIG. 8 with some portions shown in cross-section and showing eyelets in the legs of the loops.
Figure 11:
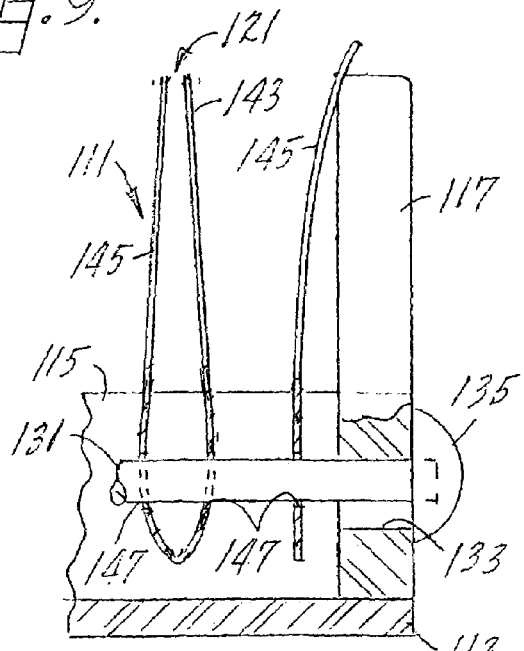
FIG. 11 is an enlarged, partial view of the storage holder of FIG. 8 with some portions shown in cross-section and showing a variation in the rod receiving openings in the legs of the loops.

A third embodiment of the desk top storage rack of this invention is shown in FIGS. 8 to 11 of the drawings with different variations of rod receiving openings or passages formed in the legs of the loops as shown in FIGS. 10 and 11 of the drawings. The desk storage rack 111 includes a base 113, side walls 115 mounted on the base and end walls 117 also mounted on the base. The end walls 117 extend well above the side walls as shown in the drawings. The storage rack may be formed of any suitable material such as a plastic, wood, paperboard, metal, etc., although plastic is preferred because of its lightweight, low cost and ease of forming.

The storage rack 111 includes a multiplicity of retainer loops 121. Each retainer loop is formed of a strip of a tough, resilient, abrasive-resistant resin, preferably a polyester resin or a laminate. The preferred construction for the strip from which the retainer loops are formed is two layers of oriented polyester terephthalate laminated with a central layer of polyethylene, the same basic construction as is used in commercial identification cards and similar articles.

An elongated loop support rod 131 is installed in the storage rack 111 extend-ing through passages 133 formed in the end walls 117 with the rod positioned between the base 113 and the top edges of the side walls 115. The ends of the rod may be fastened to the end walls 117 by caps 135 which may be threaded onto or fastened in any other conventional manner to the ends of the rod 131. The support rod is formed of circular transverse cross-section for reasons which will hereinafter be discussed, but it may also be formed with a non-circular transverse cross-section.

Each retainer loop 121 is formed with a bight portion 141 joining a pair of legs 143 and 145. An opening 147 is formed in each leg 143 and 145 with each opening being located near the distal end of its leg. The openings may be formed by stamping, cutting or in any other conventional manner suitable for forming an opening in a laminated strip of plastic. The openings are circular in transverse cross-section being only slightly larger than the transverse cross-section of the rod 131 so as to fit easily over the loop support rod 131. In the embodiment shown in FIG. 10 of the drawings, an eyelet 149 is installed around each opening 147 to strengthen the attachment between the retainer loops 121 and the rod 131 and to facilitate sliding of the loops along the rod. Other than in the legs of the loops at opposite ends of the storage rack 111 where the eyelet is installed in the opening of a single leg, each eyelet 149 connects the legs 143 and 145 of adjacent loops together and thus maintains legs of adjacent loops in contact with each other from the eyelet to the bight portion 141 of each loop. Further, the eyelets strengthen the legs adjacent the tight bends 151 formed between the legs 143 and 145 of adjacent loops and resist pull out of the loops from the support rod 131.

What is claimed is:

1. A desk top or vertical surface storage rack for small items, including:

a rectangular, U-shaped base having a pair of outwardly extending legs separated by an outwardly opening transversely extending slot, an outwardly opening strip receiving slit formed in each of said outwardly extend-ing legs and a wider strip receiving slit formed in the bottom of said slot, at least one pair of retainer loops formed of a strip of a tough, resilient, abrasive-resistant resin, each of said retainer loops having a bight portion positioned outwardly of said outwardly extending legs of said U-shaped base and two legs extending from said bight portion, one of said legs of each strip having its distal end positioned in said strip receiving slit of one of said base outwardly extending legs and the other of said legs positioned in said wider strip receiving slit in said bottom of said slot, and means to fasten the distal ends of said retainer loop legs to said base.

2. The desk top storage rack of claim 1 in which said other of said legs of each strip positioned in said wider strip receiving slit in said bottom of said slot are formed integrally with each other to form a bight portion between said pair of retainer loops.

3. The desk top storage rack of claim 1 in which said means to fasten said distal ends of said retainer loop legs to said base includes a rod extending through said upstanding legs of said base and through said retainer loops.

4. The desk top storage rack of claim 2 in which said means to fasten said distal ends of said retainer loop legs to said base includes a rod extending through said upstanding legs of said base and through said retainer loops.

5. The desk top storage rack of claim 1 in which said base has side walls extending generally at right angles to said retainer loops and a groove is formed in each of said side walls of said base for mounting said base in a receiver.

6. The desk top storage rack of claim 2 in which said base has side walls extending generally at right angles to said retainer loops and a groove is formed in each said side walls of said base for mounting said base to a receiver.

7. The desk top storage rack of claim 3 in which an opening is formed in each of said retainer loop legs near its distal end, said rod extends through said openings, each opening has an eyelet surrounding said opening with contiguous legs of adjacent retainer loops being held together by a single eyelet.

* * * * *